US005082114A

United States Patent [19]

Bunin

[11] Patent Number: 5,082,114

[45] Date of Patent: Jan. 21, 1992

[54] CHILD RESISTANT UNIT DOSE PACKAGE

[75] Inventor: Leonid Bunin, Woodbridge, N.J.

[73] Assignee: Merck & Co., Inc., Rahway, N.J.

[21] Appl. No.: 597,644

[22] Filed: Oct. 15, 1990

[51] Int. Cl.[5] ..... A61J 1/00; B65D 43/26

[52] U.S. Cl. ..... 206/539; 206/1.5; 220/283

[58] Field of Search ..... 206/1.5, 328, 528-540, 206/807; 220/263, 264, 281-283, 326

[56] References Cited

U.S. PATENT DOCUMENTS

| | | | |
|---|---|---|---|
| 3,348,724 | 10/1967 | Rosso | 220/281 |
| 3,381,850 | 5/1968 | Haugen | 220/281 |
| 3,894,655 | 7/1975 | Mattheis et al. | 220/283 |
| 3,968,880 | 7/1976 | Ostrowsky | 220/281 |
| 4,133,449 | 1/1979 | Ostrowsky | 206/540 |
| 4,535,905 | 8/1985 | Sandhaus | 220/281 |
| 4,890,742 | 1/1990 | Allison | 206/1.5 |

FOREIGN PATENT DOCUMENTS

| | | | |
|---|---|---|---|
| 1115638 | 10/1961 | Fed. Rep. of Germany | 206/534.2 |
| 0202534 | 3/1966 | Sweden | 206/540 |

*Primary Examiner*—Jimmy G. Foster
*Attorney, Agent, or Firm*—Salvatore C. Mitri; Charles M. Caruso

[57] ABSTRACT

A child resistant unit dose package for medications comprises a container member having concealed locking means, a plurality of cavities along its longitudinal axis for holding medication, each cavity closed with a peel-off seal, and a cover for the container member that requires two operations to open.

3 Claims, 2 Drawing Sheets

CHILD RESISTANT UNIT DOSE PACKAGE

BACKGROUND OF THE INVENTION

Many medications are dangerous if taken by children or if taken by children in excess. In order to prevent accidental ingestion of medications by children who encounter a medication container, it has been desirable to design medication containers that are resistant to being opened by children.

OBJECTS OF THE INVENTION

It is an object of the present invention to provide a package for medicaments that resists opening by children. It is a further object to provide a package for medicaments that has concealed locking means. Another object is to provide a package requiring a 2-step procedure to open. These and other objects of the present invention will be apparent from the following description.

SUMMARY OF THE INVENTION

A child resistant unit dose package for medications comprises a longitudinal member having a plurality of cavities, each cavity adapted to hold a unit dosage medication, each cavity sealed after filling with a peel-off seal, and a cover for the container member that requires opening a concealed snap-lock and manually lifting the cover from the container member to expose the cavities.

BRIEF DESCRIPTION OF THE DRAWINGS

In FIG. 1 the package is closed. FIGS. 2 and 3 show the means of opening the package, and FIG. 4 shows it fully opened.

DETAILED DESCRIPTION

Figure 1:
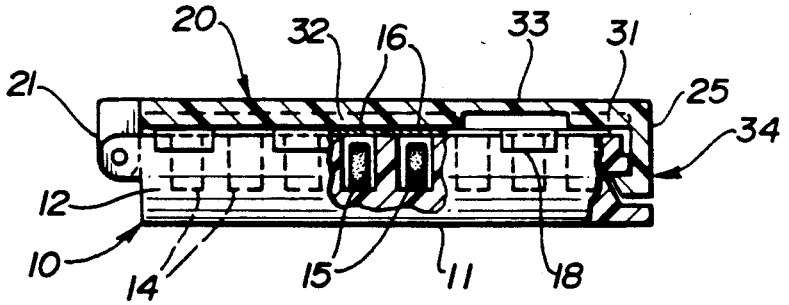
FIGS. 1, 2, 3 and 4 are midsectional side elevations along the longitudinal axis of the package of the present invention.

This invention relates to a child resistant unit dose package, and more particularly to such a package having concealed locking means wherein a two-step procedure is required to expose the cavities holding the medication.

According to the present invention the child resistant unit dosage package consists of a container member 10 having a bottom surface 12 and sidewalls 12 and 13. Container member 10 is provided with a plurality of cavities or chambers 14. Each chamber is intended to hold a tablet 15, capsule, caplet or the like of single dose medication. The cavities are covered with a protective strip 16, e.g., an aluminum foil-heat sealant laminate which is adhered to the top surfaces 17 of container member 10 by heat sealing and which is readily removed by peeling off to expose the medication. Foil 16 is provided with tabs 18 and scores 19 to facilitate opening of individual cavities by pulling the tabs.

Container member 10 is provided with cover 20 extending along substantially all of the length of member 10 and attached to member 10 by hinge means 21. Cover 20 has top 22 and sidewalls 23 and 24 that overlap the sidewalls 13 and 12, respectively, when the cover is closed. Cover 20 is provided at its front end with a downwardly projecting wall 25 that fits over the front wall 26 of container member 10. Walls 25 and 26 cooperate to form concealed locking means 34. In the embodiment shown, the locking means is formed by providing the bottom of the interior surface of wall 25 with a flange 27 adapted to fit over flange 28 provided on the outer surface of wall 25, thereby locking cover 20 to container member 10. When the package is closed the locking means are concealed.

Figure 2:
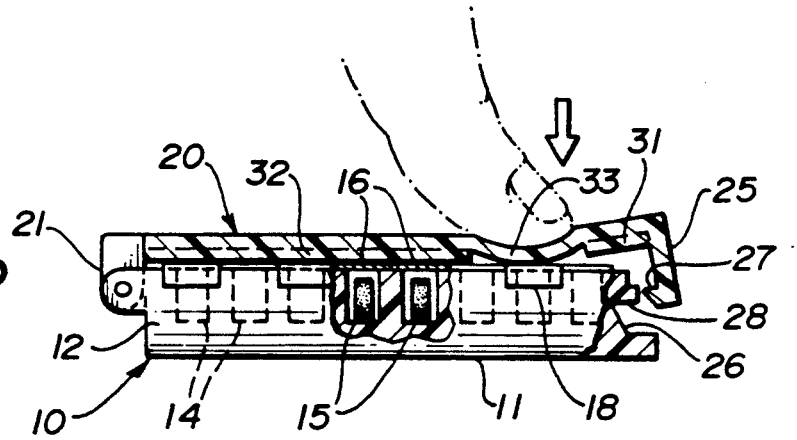
Figure 3:
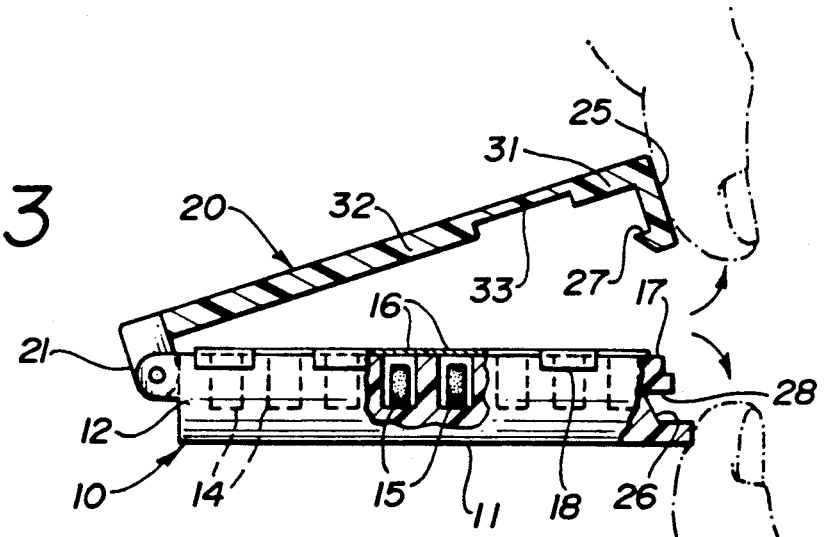
Figure 4:
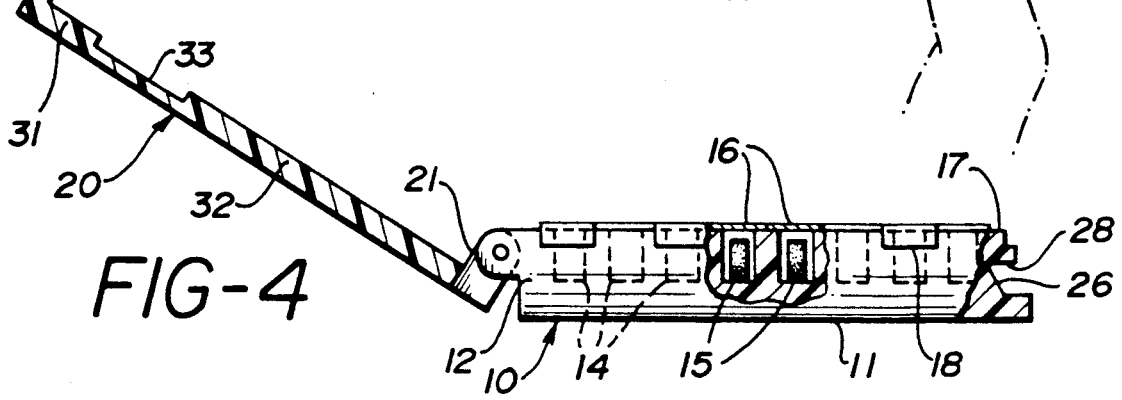
Figure 5:
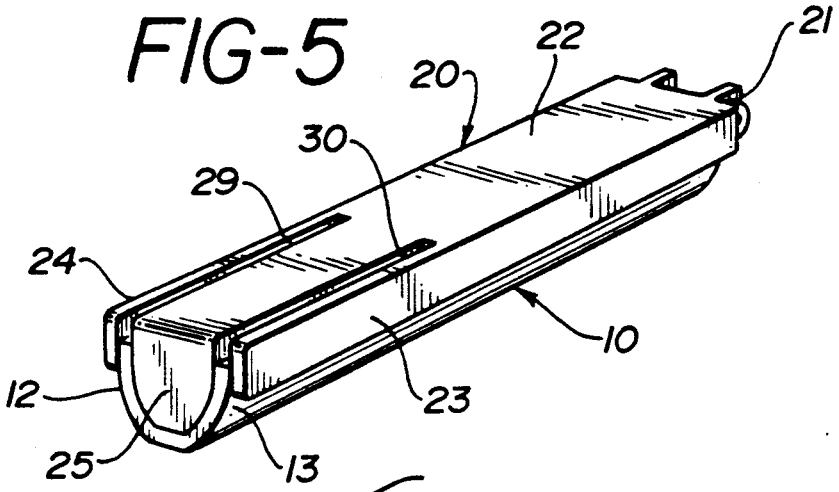
FIGS. 5 and 6 are perspective views of the child resistant unit dosage package of the present invention in closed and open positions, respectively.
Figure 6:
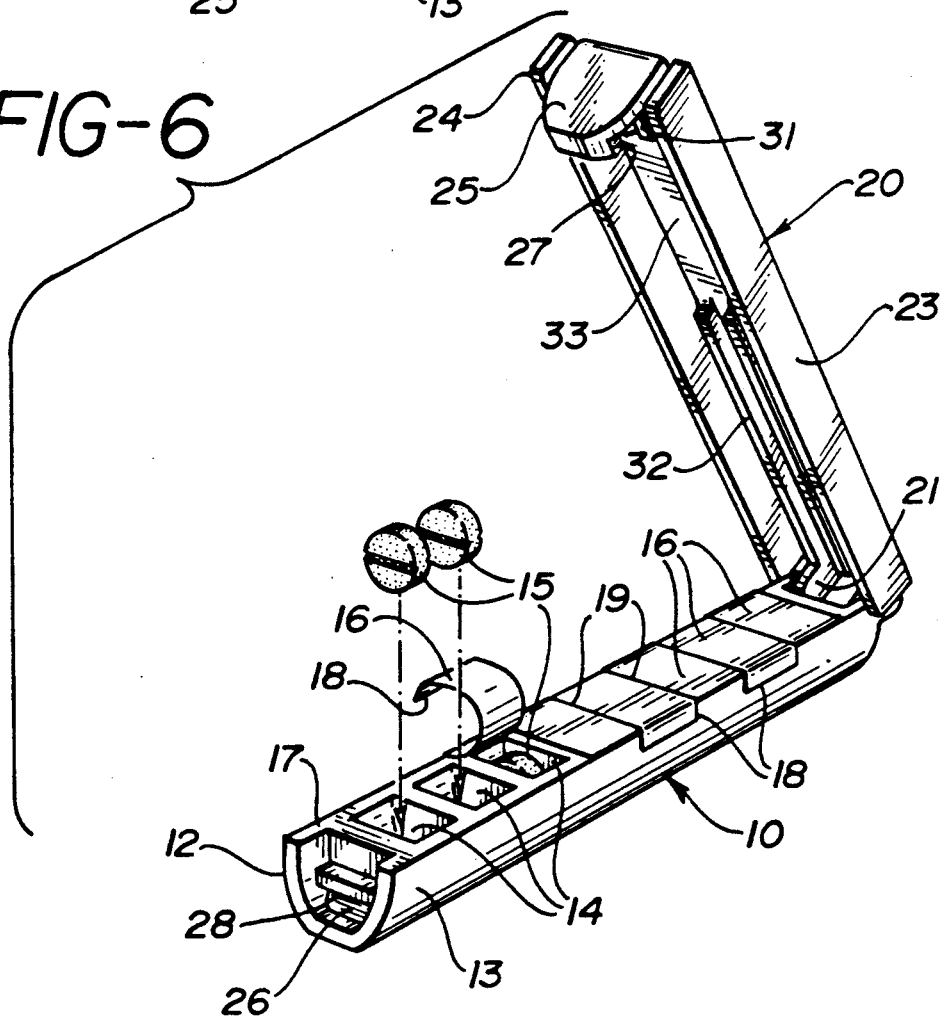

The top 22 of cover 20 is provided with slits 29 and 30 proceeding inwardly from the front edge of cover 20 and terminating before reaching the hinged end. Top 22 is also provided with one or more front reinforcing flanges 31 and rear reinforcing flanges 32. A region 33 between the two flanges 31 and 32 lacks any reinforcing flanges. When the package is closed, it is not apparent that the underside of top 22 is not uniform or that region 33 is present. Due to the presence of region 33 and also to slits 29 and 30, pressure on region 33 as shown in FIG. 2, disengages interlocking flanges 27 and 28. However, the cover 20 does not swing away from container member 10 due to frictional engagement between front wall 25 and 26 of cover 20 and container member 10, respectively, and between sidewalls 12 and 13 of container member 10 and sidewalls 23 and 24 of cover 20. In order to open the package, it is necessary in addition to hold the front ends of the container member 10 and cover 20 and pull them apart as shown in FIG. 3. The unit dose package of the present invention can be made of many suitable materials but moldable plastic is preferred. Polyethylene, either low or high density, can be used as can polypropylene. For cost considerations, low density polyethylene is preferred.

What is claimed is:

1. A unit dosage package comprising:

(a) a container member adapted to receive medication in dosage form, said container member having:
  (i) opposed, upwardly extending side walls;
  (ii) opposed, upwardly extending front and rear walls; and,
  (iii) an outwardly projecting flange on said front wall; and, (b) a cover member sized to fit over said container member and having:
  (i) a downwardly extending rear wall hingeably secured to the upwardly extending rear wall of said container member;
  (ii) a downwardly extending front wall opposed to said downwardly extending rear wall and having an inwardly projecting flange adapted to engage the outwardly projecting flange on the front wall of said container member in interlocking relationship, said interlocking relationship being concealed when said container member and said cover member are closed and secured to each other by said interlocking relationship;
  (iii) opposed, downwardly extending reinforcing flanges which partially overlap the opposed, upwardly extending side walls of said container member, said reinforcing flanges being interrupted to define a non-reinforcing area; and,
  (iv) opposed peripheral slits extending inwardly from the front edge of said cover member in the area substantially common with said non-reinforcing area, said peripheral slits and said nonreinforcing area together forming a flexing region in said cover member such that when pressure is applied to said flexing region, said outwardly and said inwardly projecting flanges become disengaged permitting said cover member to be rotated to open said dosage package.

2. The unit dosage package of claim 1 wherein a plurality of cavities are defined in said container member to receive said medication in dosage form.

3. The unit dosage package of claim 2 wherein said cavities are covered with peel-away protective strips.

* * * * *